US005113684A

United States Patent [19]

Oster

[11] Patent Number: 5,113,684

[45] Date of Patent: May 19, 1992

[54] ELECTRONIC BRAKING SYSTEM FOR POWER PRESS DIE CHANGE CARRIERS

[75] Inventor: Eugene A. Oster, Chicago, Ill.

[73] Assignee: Connell Limited Partnershp, Boston, Mass.

[21] Appl. No.: 601,338

[22] Filed: Oct. 22, 1990

[51] Int. Cl.[5] ..... B21J 13/08

[52] U.S. Cl. ..... 72/448; 72/446; 100/918; 100/229 R

[58] Field of Search ..... 72/446, 448, 481; 100/918, 229 R

[56] References Cited

U.S. PATENT DOCUMENTS

| | | | |
|---|---|---|---|
| 3,002,479 | 10/1961 | Johansen et al. | 72/446 |
| 3,207,065 | 9/1965 | Danly . | |
| 3,368,479 | 2/1968 | Gregorovich | 72/446 |
| 3,841,142 | 10/1974 | Aisuta et al. | 72/448 |
| 4,360,536 | 12/1986 | Shah . | |
| 4,408,521 | 10/1983 | Schelli et al. . | |
| 4,614,108 | 9/1986 | Bolle et al. | 72/446 |
| 4,660,406 | 4/1987 | Rugh et al. | 72/448 |

FOREIGN PATENT DOCUMENTS

| | | | |
|---|---|---|---|
| 1447084 | 6/1966 | France | 72/448 |

OTHER PUBLICATIONS

Allen-Bradley Product Data Publication 1336-2.-4-Apr. 1990; Bulletin 1336 Adjustable Frequency AC Drive.

Allen-Bradley Product Data Publication 13364-2.-0-Nov. 1986; Bulletin 1334 Adjustable Frequency AC Motor Drives.

Allen-Bradley Kit Instructions Publication 1334-5.0.-46-Apr. 1989; 1334-MOD-K8 15 & 20HP Series A Dynamic Brake.

Allen-Bradley Selection Data Publication 1333-2.-4-Oct. 1989; Bulletin 1333 Heavy Duty Dynamic Braking.

*Primary Examiner*—David Jones

*Attorney, Agent, or Firm*—Leydig, Voit & Mayer

[57] ABSTRACT

The invention provides an automatic die changing system for a power press with at least one carrier for transporting dies to and from a selected location in the press. The carrier is supported on a set of wheels, which are driven by at least one AC induction motor. An adjustable frequency AC motor drive supplies an AC frequency and voltage to the AC induction motor to control the speed of the motor and therefore the speed of a horizontal movement of the carrier into or out of the press. The speed of the carrier may be rapidly increased by increasing the AC frequency supplied to the motor on the individual wheels. A proximity detector signals the motor drive to trip a dynamic braking resistor, which electronically changes the phase order of the motors to reverse the direction of motor rotation, to decelerate the carrier in order to locate the carrier in the proper position.

17 Claims, 4 Drawing Sheets

ELECTRONIC BRAKING SYSTEM FOR POWER PRESS DIE CHANGE CARRIERS

FIELD OF THE INVENTION

The present invention relates generally to automatic die changing systems for power presses, and more particularly, to braking systems for die change carriers.

BACKGROUND OF THE INVENTION

As power presses have continued to increase in size and capability, the dies for use in such presses have accordingly increased both in size and weight. Much time and energy, hence cost, must be expended each time these dies are changed. It is, therefore, advantageous to provide mechanically and electrically controlled moving and sliding carriers to facilitate quick die changes.

In the past, bolsters or carriers having sets of wheels driven by hydraulic and pneumatic drive systems have been used extensively in various applications to carry heavy dies. In order to reduce both the amount of downtime for large power presses and the cost of labor of press room workers during changeover from one set of dies to another, manufacturers have long sought to decrease the cycle time of this die changing operation. Also, due to changing economics, modern factories install fewer press lines, which has given rise to frequent die changes for running different parts. It is not uncommon for factories to seek several die changes in a day. In the past, changes were made far less frequently, therefore factories could tolerate fairly long die changing times. Thus, it is now desirable to move the first die carrier out of the press and the second die carrier into the press as quickly as possible.

In moving the carriers into position, various methods have been used to arrest the movement of the carrier once in position. One such method is to install bumpers or stops that stop the movement of the carrier upon impact. Another method has been to cut the motor and allow the carrier to coast to a stop due to the force of friction. Additionally, mechanical brakes have been used to stop the forward movement of the carrier. While each of these methods may stop the motion of the carrier, these methods may be undesirable insofar as each requires a long braking distance or exhibits safety problems due to the inertia of the carrier. As a result, the methods are generally unsatisfactory for providing rapid die changes.

OBJECTS OF THE INVENTION

Accordingly, it is a primary object of the present invention to provide a die change system which allows the dies to be changed rapidly in order to minimize downtime. It is therefore a related object to provide a die change system which provides maximum acceleration and deceleration of the bolster to position the carrier in the desired location.

It is a further object of the invention to minimize downtime by moving the old bolster out of position and the new bolster into position substantially simultaneously.

Another object of the invention is to provide a die change motor drive system which will likewise provide braking torque to arrest motion of the bolster.

An additional object of the invention is to provide a die change drive and braking system having an uncomplicated, rugged construction which is of high reliability.

Still another object of the invention is to provide a drive and braking system having low overall operating costs due to good efficiency and low maintenance costs.

SUMMARY OF THE INVENTION

In accomplishing these objects, the invention provides an automatic die changing system for a power press with at least one carrier for transporting dies to and from a selected location in the press. A carrier is supported on a set of wheels, each having a separate AC induction motor. An adjustable frequency AC motor drive supplies an AC frequency and voltage to the AC induction motors to control the speed of the motors and therefore the speed of a horizontal movement of the carrier into and out of the press. The speed of the carrier may be rapidly increased by increasing the AC frequency supplied to the motors on the individual wheels. In order to position the carrier in a desired location within or outside of the press, a proximity detector signals the motor drive to trip a dynamic braking resistor that electronically changes the phase order of the motors to reverse the direction of motor rotation, thereby decelerating the carrier. The carrier is then inched into the proper position.

BRIEF DESCRIPTION OF THE DRAWINGS

For the purposes of facilitating and understanding of the invention, the accompanying drawings illustrate a preferred embodiment. The above and other objects of the invention, as well as the features thereof as summarized above will become more apparent from the following description when taken in conjunction with the accompanying drawings.

DESCRIPTION OF THE PREFERRED EMBODIMENT

While the invention will be described in connection with certain preferred embodiments, it will be understood that it is not intended to limit the invention to these particular embodiments. On the contrary, it is intended to cover all alternatives, modifications, and equivalents included within the spirit and scope of the invention as defined by the appended claims.

Figure 1:
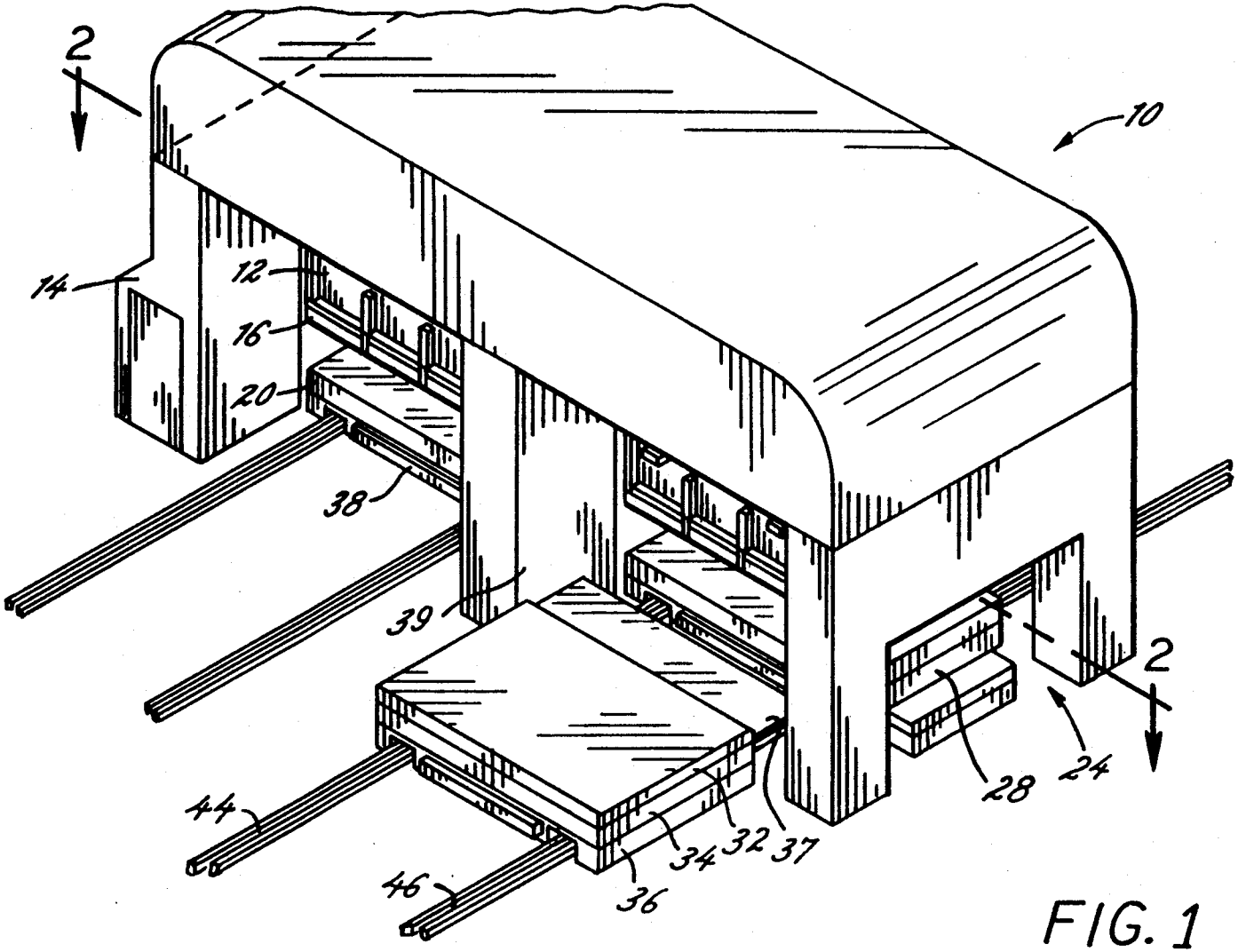
FIG. 1 is a perspective view of a transfer feed dual slide power press utilizing a braking system according to the present invention.

Turning now to the drawings and referring first to FIG. 1, there is shown a transfer feed dual press 10 having vertically movable slides 12, which are supportedly guided by a plurality of columns 14. While the invention will generally be described with reference to a transfer feed dual slide press 10, it will be appreciated that the invention is likewise applicable to a press having only a single unit, or presses having any number of units disposed in succession.

In working operation, the slide 12 carries the upper half of the die 16 and is reciprocated vertically through a full cycle by a conventional motor drive mechanism (not shown) such that the upper half of the die 16 and the stationary lower half of the die 20 are alternately brought into and out of contact. Workpieces are fed into the press through an opening at an end or side of the press, and positioned on the lower die 20 while the slide 12 is in a raised position. The workpiece is then worked by the downward stroke of the press slide 12. In the transfer feed press shown in FIG. 1, the workpiece is fed into the press 10 through an opening 24 on the right hand side of the press. The workpiece is then worked by downward strokes of the press as it is progressed through the dies 16, 20 by an automatic workpiece transfer system. One such workpiece transfer system is disclosed in U.S. Ser. No. 602,118 by Anthony Rante filed Oct. 22, 1990 for "Backlash Reduction System for Transfer Feed Press Rail Stands." After press operations are complete, the workpiece is removed from the press 10 through an opening 26 (shown in FIG. 2) on the left side of the press 10. While the invention is described in connection with a transfer press, it will be appreciated that the invention is likewise applicable to other types of presses, such as a single slide press wherein the workpiece is positioned on the lower die 20, worked by the downward stroke of the press slide 12, and then removed through the same opening or through a like opening on the opposite side of the press.

Figure 4:
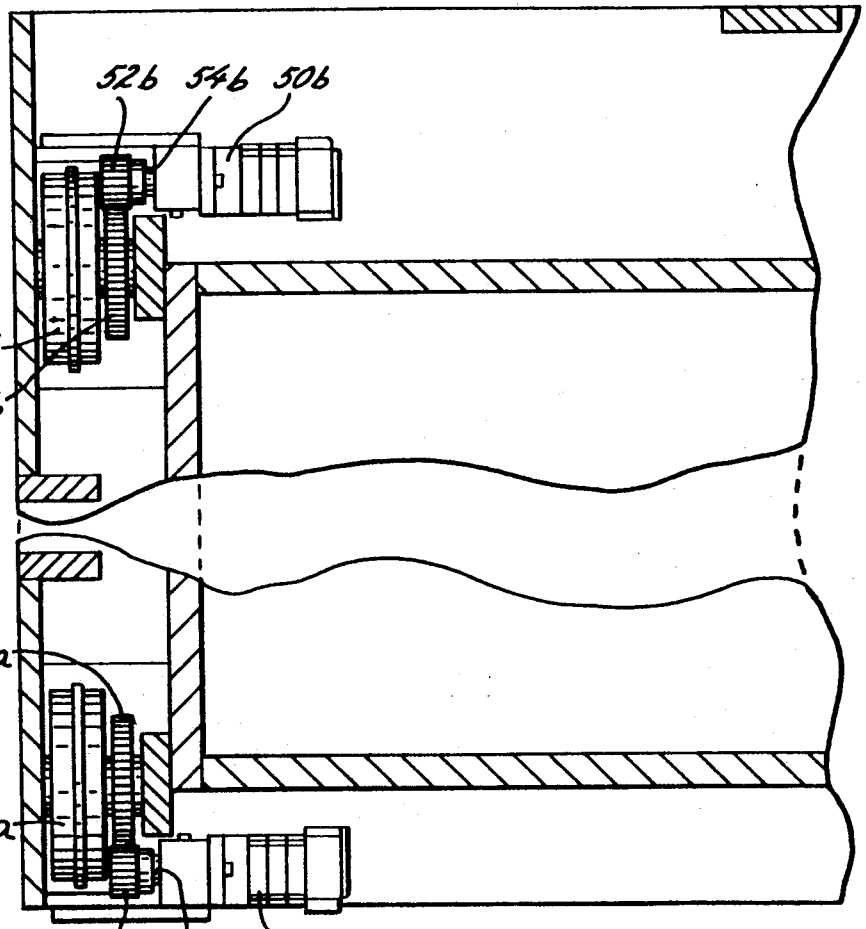
FIG. 4 is a fragmentary top plan view of the die carrier shown in FIG. 1.
Figure 3:
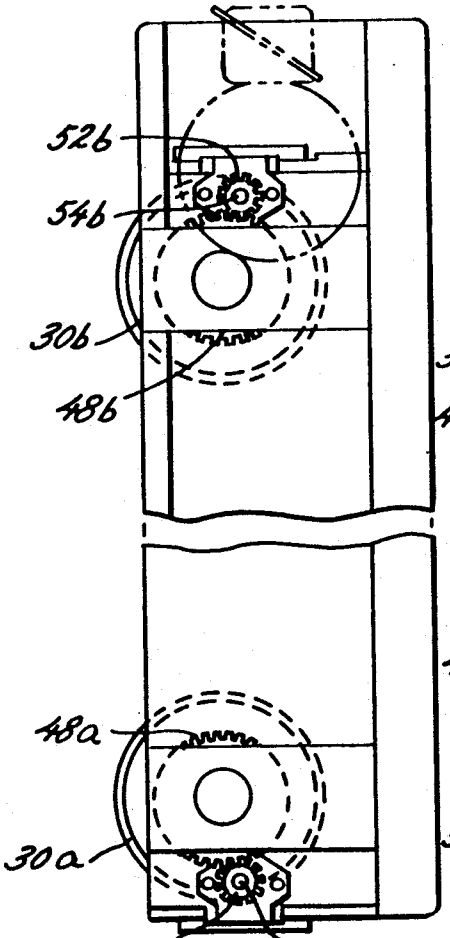
FIG. 3 is a fragmentary end elevation of the die carrier shown in FIG. 1.

The lower half of the die 20 is supported on a bolster or carrier 28, which is shown within the press 10 in FIG. 1. In order to facilitate quick die changes, the carrier 28 is provided with wheels 30 (shown in detail in FIGS. 3 and 4). Further, a different die 32, 34 is supported on another carrier 36, which is located just outside the press 10 in FIG. 1. The carriers 28, 36 may be equipped with horizontal extensions 37, which may be of metal or the like, to provide an elevated walkway between the carriers 28, 36. Further, the carriers may be equipped with bumpers 38, the purpose of which will be described in more detail in connection with the drive system.

Figure 2:
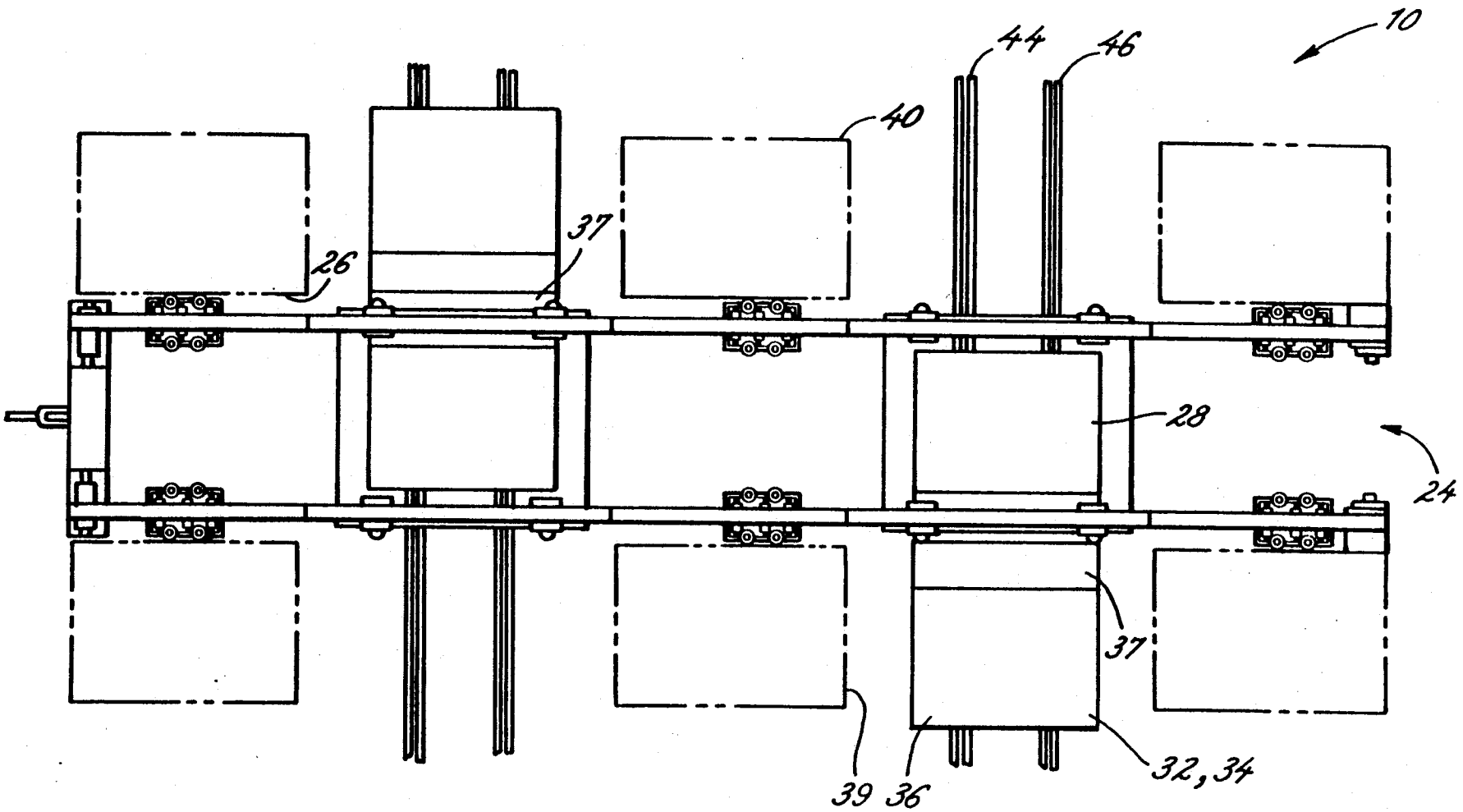
FIG. 2 is a top view of the press taken generally along line 2—2 in FIG. 1.

Pairs of openings 39, 40 formed in opposite sides of the press permit access to the interior of the press by the pair of carriers 28, 36. In this way, the carrier 28 may be moved out of the press 10 and the carrier 36 may be moved into the press 10 in order to change the dies utilized during operation of the press 10. As shown in FIG. 2, the direction of movement of the carriers 28, 36 is at right angles to the direction of movement of the workpieces so as to avoid interference with the automatic workpiece transfer mechanisms that are commonly used to load and unload the workpieces. The two carriers 28, 36 enter the press from opposite sides so that whenever one of the carriers is in the press or in the process of entering the press, the other carrier can be used to remove the old set of dies from the press and receive the new set of dies for the next die change. As stated above, the carriers 28, 36 are supported on sets of wheels 30*a*, 30*b*, 30*c*, 30*d* (see FIGS. 3 and 4), which are driven on two pairs of tracks 44, 46 that guide the carriers 28, 36 to and from the press.

In accordance with the invention, the wheels 30*a*, 30*b*, 30*c*, 30*d* are driven by one or more AC induction motors. In order to control the speed of the motors on the four wheels of the carrier so that each wheel rotates at the same variable speed, an AC variable frequency motor drive is provided for each carrier. The AC variable frequency motor drive converts the three-phase, 60 hz line, fixed frequency input power to an adjustable AC frequency and voltage source to control the speed of the motors. The drive controls the motor torque so that the speed of the motor will rapidly increase to and maintain a desired speed to move the carrier to a desired position; further, the drive will operate as a dynamic brake by changing the phase sequence in the motor to reverse the direction of rotation and arrest the movement of the carrier, when an input signal from a transductor or mechanical switch so directs the drive unit.

While the invention will be described in connection with a single carrier 28, it will be appreciated that the remaining carriers are provided with similar components. The carrier 28 wheels 30*a* and 30*b* are shown in detail in FIGS. 3 and 4. Only wheels 30*a*, 30*b* of the set of four wheels are illustrated, but it will be recognized that the other two wheels 30*c*, 30*d* have a similar construction. Attached to the wheels 30*a*, 30*b* are corresponding gears 48*a*, 48*b*, which are driven by respective AC induction motors 50*a*, 50*b* via gears 52*a*, 52*b* on the output shafts 54*a*, 54*b* of the motors in the preferred embodiment of the invention. Because each wheel 30*a*, 30*b*, 30*c*, 30*d* has its own drive motor 50*a*, 50*b*, 50*c*, 50*d*, no connecting shafts, couplers or speed reducers are required. It will be appreciated that through the use of shafts or couplers, fewer than four motors per carrier may be utilized for slower moving or lighter carriers if the resultant deceleration is sufficient. The AC induction motors 50*a*, 50*b*, 50*c*, 50*d* are operated by an adjustable frequency AC motor drive 56, which will be described in more detail below in connection with FIG. 5. While the preferred embodiment utilizes AC induction motors, other types of drive motors for each wheel may be utilized with modification to the adjustable frequency AC motor drive.

Figure 5:
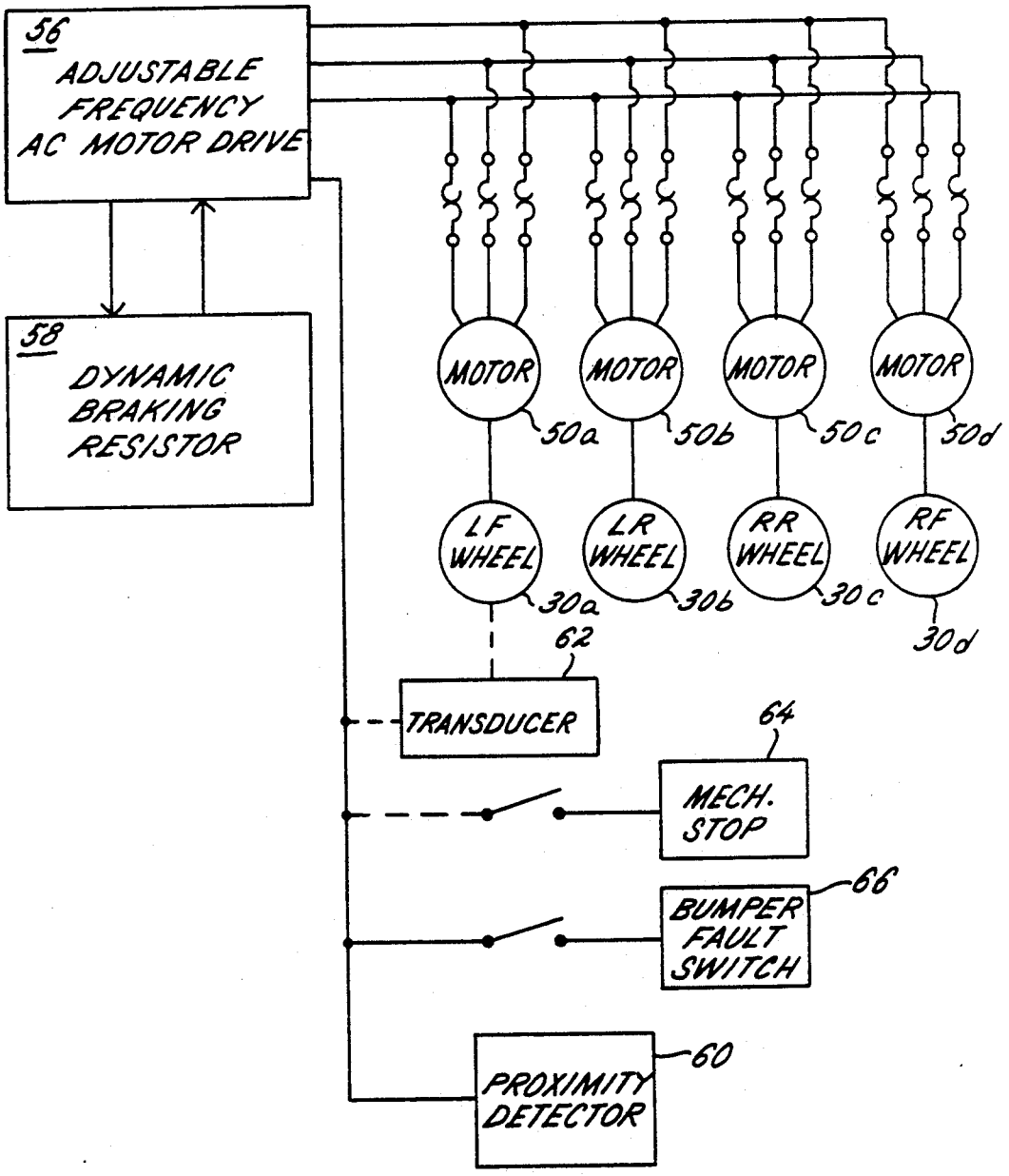
FIG. 5 is a schematic representation of the carrier control system of the present invention.

Turning now to FIG. 5, there is shown a schematic representation of the speed control system of the present invention for a single carrier 28. It will be appreciated that similar systems are provided for each carrier of the press. As explained above, in the illustrated embodiment, separate induction motors 50*a*, 50*b*, 50*c*, 50*d* are provided for the respective wheels 30*a*, 30*b*, 30*c*, 30*d* of the carrier. In a preferred embodiment of the invention, each motor 50 is a three hp, 1800 rpm, three-phase AC induction motor. In this way, because the motors have identical pole pair numbers and load torques, the output speed of the motors will be the same when the same input voltage and frequency is supplied to each motor 50. As a result, the respective wheels 30 will rotate at the same speed to efficiently move the carrier 28 into position.

In order to drive the motors 50, an adjustable frequency AC motor drive 56 is provided. A preferred embodiment of the invention utilizes a 15–25 hp, adjustable frequency AC motor drive, such as an Allen Bradley 1334 Adjustable Frequency AC Motor Drive or an Allen Bradley 1336 Adjustable Frequency AC Motor Drive, which are disclosed in more detail in the Allen Bradley Product Data Publication 1334-2.0 - November, 1986 and the Product Data Publication 1336-2.4 - April, 1990, respectively, or, more particularly, an Allen Bradley 1334F, 15–25 hp AC Variable Frequency Motor Drive. As will be appreciated by one skilled in the art, the AC motor drive includes power conversion components and control and logic circuitry to convert a fixed frequency, three-phase input power to an adjustable AC frequency and voltage source. The motor drive includes a frequency inverter equipped with a DC rectifier and a DC bus. The output AC frequency and voltage will directly control the speed of the AC induction motor 50.

According to an important aspect of the invention, the AC motor drive 56 includes various options that facilitate control of the output signal to control speed and mode of the motors 50. A preferred embodiment utilizes Allen Bradley 1334 F with the control/signalling card-option W1, the isolated signal conditioner card-option N, and the dynamic braking-option K8. It will be appreciated that alternate options may be appropriate in other AC drive units to modify the standard drive for this custom application. These options allow the drive to accept an input follower signal from a supplied source and use it as a reference for the drive output frequency. The supplied signal is converted to a form that is usable by the drive when the optional feature generates a frequency proportional to the input signal that is delivered to the logic circuitry of the drive as a speed reference. Accordingly, the output of the drive may be modified to control the speed of the motors 50 and therefore the motion of the carrier 28 into and out of the press 10.

According to another important aspect of the invention, the adjustable frequency AC motor drive 56 may likewise be used to reverse the motors' 50 direction of rotation in order to brake the wheels 30. This is due to the fact that the frequency inverter of the AC motor drive may accommodate a power flow in either direction through the actual converter. In order to cause a braking operation, the drive output to the AC induction motor is cut. As a result, the induction motor 50 will act as a generator to produce a power flow in reverse direction. As the power flows through the inverter to the DC circuitry, the DC bus voltage will rise when energy from the motor is transferred to the DC bus during a braking operation. The drive monitors the DC bus voltage and at a predetermined value connects the dynamic brake resistor 58 across the DC bus to absorb the excess energy. As a result, the motor drive 56 will produce an output to electronically change the phase order of the motor 50 in order to change the direction of the motor 50 rotation. In this way, the AC motor drive will function as a brake to decelerate the carrier 28. It will be appreciated that a supplemental mechanical braking system (not shown) may be utilized if the dynamic braking system is insufficient to stop the carrier 28 in the required time.

In order to activate the dynamic braking system, a proximity detector 60 is provided. The proximity detector 60 will sense the position of the carrier 28 on the track to initiate the braking function. Thereafter, the carrier 28 will be permitted to inch to its final position. It will be appreciated that other signal means may be used to trigger the dynamic braking function, such as a transducer 62, which senses the number of rotation of the wheels 30 and therefore the position of the carrier 28, or mechanical switch 64 at a stop position, as shown in broken lines in FIG. 5. As an additional safety feature, a bumper fault switch 66 is provided within the bumper 38 on the side of the carrier 28. If the bumper 38 encounters an obstruction, the fault switch 66 will trigger the dynamic braking function in order to arrest the forward movement of the carrier 28.

It will be appreciated that the exemplified die change system meets the objectives of the invention in that it allows the dies to be changed rapidly in order to minimize down time. For example, an actual application of the invention utilizes one three-horsepower motor, having four poles per motor and a maximum speed of 1800 rotations per minute, per wheel, and a fifteen to twenty-five horsepower AC variable frequency drive. In this application, an approximately fifty-ton carrier 28 and die 20 accelerates to and decelerates from a speed in the range of thirty-nine to forty-nine feet per minute within a distance of approximately 190 inches. As a result, a complete die change, including rail disconnect time, may be accomplished in around 117 seconds.

In summary, an AC variable frequency motor drive 56 drives AC induction motors 50 to accelerate and brake the individual wheels 30 of each carrier. The AC motor drive 56 supplies power to provide maximum acceleration so that the carrier 28 may reach its maximum speed in minimum time. This maximum speed may be maintained until the carrier 28 reaches a predetermined location on the track at which time a proximity switch 60 triggers the dynamic braking function of the AC motor drive 56 to decelerate the carrier 28. As a pair of carriers 28, 36 for a single press are provided with separate AC induction motors 46 and separate AC motor drives 52 for each carrier 28, 36, the carriers 28, 36 may be rapidly moved into and out of the press simultaneously.

I claim as my invention:

1. An automatic die changing system for a power press comprising:

at least one carrier for transporting dies to and from a selected location in the press, a set of wheels supporting the carrier for horizontal movement to position the dies horizontally, at least one AC induction motor for driving the wheels, an adjustable frequency AC motor drive for supplying an AC frequency and voltage to the AC induction motor to control the speed of the motor whereby the speed of the wheels and the horizontal movement of the carrier is determined by the AC frequency supplied to the motor.

2. An automatic die changing system as claimed in claim 1 wherein the motor drive will operate as a dynamic brake to reduce the speed of the carrier when tripped by a signal means.

3. An automatic die changing system as claimed in claim 2 wherein the signal means comprises a proximity detector.

4. An automatic die changing system as claimed in claim 3 further comprising at least two tracks, said proximity detector sensing the position of the wheels with respect to the tracks.

5. An automatic die changing system as claimed in claim 2 wherein the signal means comprises a transducer which sensing the number of rotations of at least one wheel.

6. An automatic die changing system as claimed in claim 2 wherein the signal means comprises a fault switch.

7. An automatic die changing system as claimed in claim 6 wherein the carrier further comprises a bumper, the fault switch being triggered by contact with the bumper.

8. An automatic die changing system as claimed in claim 2 wherein the signal means comprises a mechanical stop.

9. An automatic die changing system as claimed in claim 1 comprising a pair of carriers, each carrier having an adjustable frequency AC motor drive.

10. An automatic die changing system as claimed in claim 2 comprising a pair of carriers, each carrier having an adjustable frequency AC motor drive.

11. An automatic die changing system as claimed in claim 9 wherein each carrier has horizontal extension, said extensions substantially overlapping to form a walkway between the carriers.

12. An automatic die changing system as claimed in claim 10 wherein each carrier further comprises a horizontal extension, said extensions substantially overlapping to form a walkway between the carriers.

13. An automatic die changing system as claimed in claim 2 wherein the carrier decelerates rapidly until the carrier reaches a location substantially near the selected location in the press and then the carrier moves slowly into the selected location.

14. An automatic die changing system as claimed in claim 1 wherein the power press is a transfer feed or press which comprises an automatic work piece transfer mechanism, the direction of horizontal movement of the carriers being at right angles to the direction of movement of the workpieces.

15. An automatic die changing system as claimed in claim 2 wherein the power press is a transfer feed or press which comprises an automatic work piece transfer mechanism, the direction of horizontal movement of the carriers being at right angles to the direction of movement of the workpieces.

16. An automatic die changing system as claimed in claim 14 wherein the power press compresses two side by side units, four carriers each having a set of wheels and a separate induction motor for each wheel, and four adjustable frequency AC motor drives.

17. An automatic die changing system as claimed in claim 1 comprising a separate AC induction motor for each wheel.

* * * * *